US012135134B2

(12) United States Patent
Happe

(10) Patent No.: US 12,135,134 B2
(45) Date of Patent: Nov. 5, 2024

(54) DEVICE FOR REGULATING A SUPPLY OF GAS

(71) Applicant: Maxitrol GmbH & Co. KG, Thale (DE)

(72) Inventor: Barbara Happe, Quedlinburg ot Gernrode (DE)

(73) Assignee: MAXITROL GMBH CO. KG (DE)

( * ) Notice: Subject to any disclaimer, the term of this patent is extended or adjusted under 35 U.S.C. 154(b) by 671 days.

(21) Appl. No.: 17/286,270

(22) PCT Filed: Oct. 25, 2019

(86) PCT No.: PCT/EP2019/000297
§ 371 (c)(1),
(2) Date: Apr. 16, 2021

(87) PCT Pub. No.: WO2020/094245
PCT Pub. Date: May 14, 2020

(65) Prior Publication Data

US 2021/0356133 A1 Nov. 18, 2021

(30) Foreign Application Priority Data

Nov. 6, 2018 (DE) ..... 10 2018 008 693.4

(51) Int. Cl.
*F24C 3/12* (2006.01)
*F23D 23/00* (2006.01)
*F24C 3/10* (2006.01)

(52) U.S. Cl.
CPC ..... *F24C 3/12* (2013.01); *F23D 23/00* (2013.01); *F24C 3/103* (2013.01); *F23D 2207/00* (2013.01)

(58) Field of Classification Search
CPC ..... F24C 3/12; F24C 3/103; F23D 23/00
(Continued)

(56) References Cited

U.S. PATENT DOCUMENTS 3,386,656 A 6/1968 Bergquist
8,065,998 B2 11/2011 Espina et al.
2009/0039223 A1* 2/2009 Arnold ..... F23Q 3/002 248/229.26

FOREIGN PATENT DOCUMENTS

FR 1494853 A 9/1967
WO 2016189500 A1 12/2016

OTHER PUBLICATIONS

International Search Report for Application No. PCT/EP2019/000297 dated Feb. 27, 2020, 2 pages.
(Continued)

*Primary Examiner* — Vivek K Shirsat
(74) *Attorney, Agent, or Firm* — McDonald Hopkins LLC

(57) ABSTRACT

A universally applicable regulation function is provided for a gas-operated heating device with more than one burner. The function facilitates start-up, regulation, and deactivation processes. A first valve and a second valve are connected together in a gas-tight manner. The first valve has an ignition lock which closes the main gas flow in the event of an ignition, a thermoelectric ignition fuse, a thermostat, and optionally an integrated pressure regulator. The start-up of the first valve allows the activation and deactivation of the gas flow. The first valve has two gas outlets, a first outlet for connecting the second valve, wherein the first outlet is located downstream of the ignition fuse and the optional pressure regulator and upstream of the thermostat, and a second outlet downstream of the thermostat, the second outlet leading to a first burner. The second valve is a thermostat. The first outlet of the first valve is connected to the inlet of the second valve, and the outlet of the second valve is connected to a second burner.

17 Claims, 7 Drawing Sheets

(58) Field of Classification Search
USPC ..... 431/54, 60
See application file for complete search history.

(56) References Cited

OTHER PUBLICATIONS

Machine-Assisted English translation for FR 1 494 853 A extracted from the espacenet.com database on Apr. 26, 2021, 5 pages.

* cited by examiner

DEVICE FOR REGULATING A SUPPLY OF GAS

CROSS-REFERENCE TO RELATED APPLICATIONS

This application is the National Stage Patent Application of International Patent Application No. PCT/EP2019/000297 filed Oct. 25, 2019, which claims priority to and all the benefits of German Patent Application No. 102018008693.4 filed Nov. 6, 2018, which are both hereby incorporated by reference in their entirety.

TECHNICAL FIELD

The disclosure relates to a regulation function for a gas-operated heating device according to the preamble to the first claim.

BACKGROUND

In the field of commercial kitchen technology two or more preparation areas are often separately regulated in an application. This operation requires the use of several gas valves, each fitted with a thermoelectric ignition fuse and thermostat, as well as the same number of pilot burners.

For example, an application is known from U.S. Pat. No. 8,065,998B2, which relates to the regulation function for a griddle. Three valves are used in this application to regulate two preparation areas. A valve for closing the main gas flow with a thermoelectric ignition fuse and two thermostats are used. An additional disadvantage, apart from the high cost of at least three valves, and the complicated design, is that a separate device is required to switch the griddle off, which entails additional expenditure on design and operation.

For example, an application is known from U.S. Pat. No. 8,065,998B2, which relates to the regulation function for a griddle. Three valves are used in this application to regulate two preparation areas. A valve for closing the main gas flow with a thermoelectric ignition fuse and two thermostats are used. An additional disadvantage, apart from the high cost of at least three valves, and the complicated design, is that a separate device is required to switch the griddle off, which entails additional expenditure on design and operation.

SUMMARY

The disclosure addresses the problem of developing a universally applicable regulation function for a gas-operated heating device with more than one burner, said regulation function facilitating a start-up, regulation function and deactivation process. Each burner is to be capable of being regulated and switched on and off independently. The design and manufacture of the device are to be as simple and inexpensive as possible.

The problem is solved according to the disclosure in that two valves are connected together in a gas-tight manner.

The first valve has an ignition lock which closes the main gas flow in the event of an ignition, a thermoelectric ignition fuse, a thermostat and, optionally, an integrated pressure regulator.

The start-up of the first valve allows the activation and deactivation of the gas flow, and has optionally an integrated piezo igniter or, alternatively, a switch for activating an electric igniter.

The first valve has two gas outlets, a first gas outlet for connecting the second valve, wherein the first gas outlet is located downstream of the ignition fuse and the optional pressure regulator, and upstream of the thermostat, and a second gas outlet is located downstream of the thermostat, said second gas outlet leading to the first burner.

The second valve is a thermostat. The first outlet of the first valve is connected to the inlet of the second valve. The outlet of the second valve is connected to the second burner.

A solution has therefore been found which enables the disadvantages of the prior art set out above to be eliminated.

At the same time the solution is characterised by its simple design and simple mode of operation.

Advantageous embodiments of the disclosure are set out in the dependent claims.

In one embodiment both valves have approximately the same pressure drop between the inlet of the first valve and the outlets of both valves, enabling two identical burners to be operated.

In an additional advantageous embodiment of the device both thermostats have a cut-out function.

BRIEF DESCRIPTION OF THE DRAWINGS

The disclosure is described in more detail below by means of execution examples which show the following.

For the first example.

Figure 4:
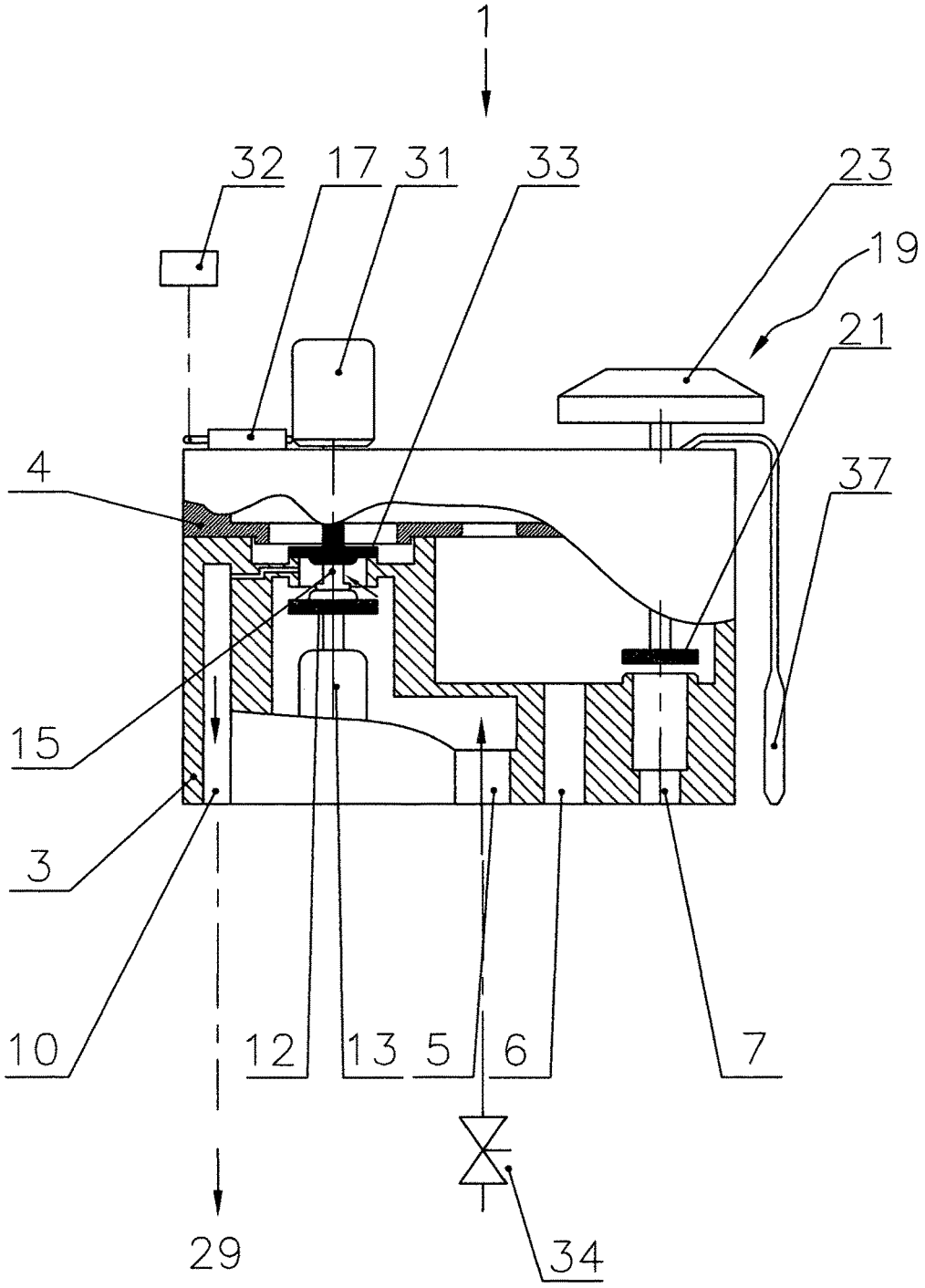
Figure 5:
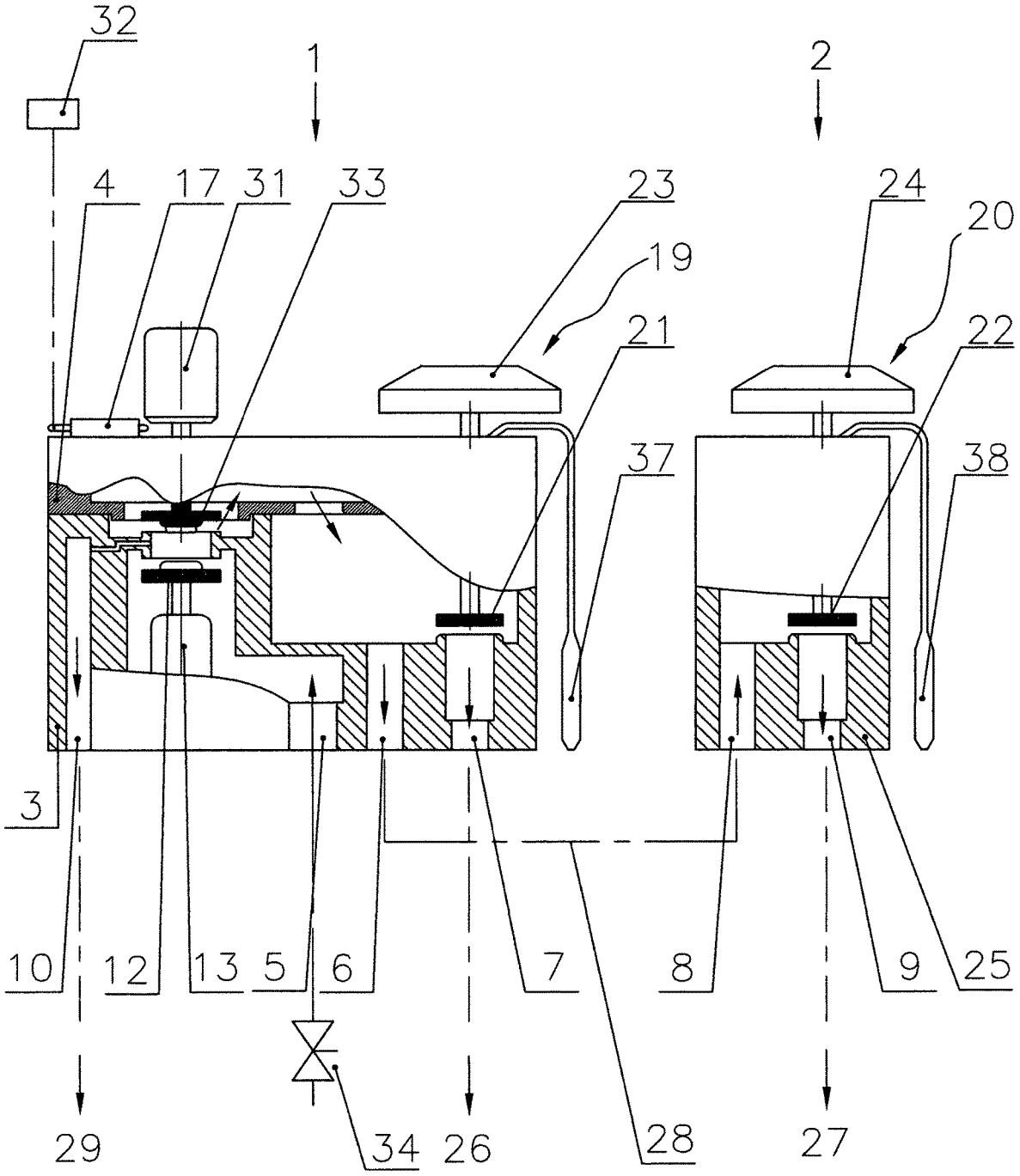
Figure 6:
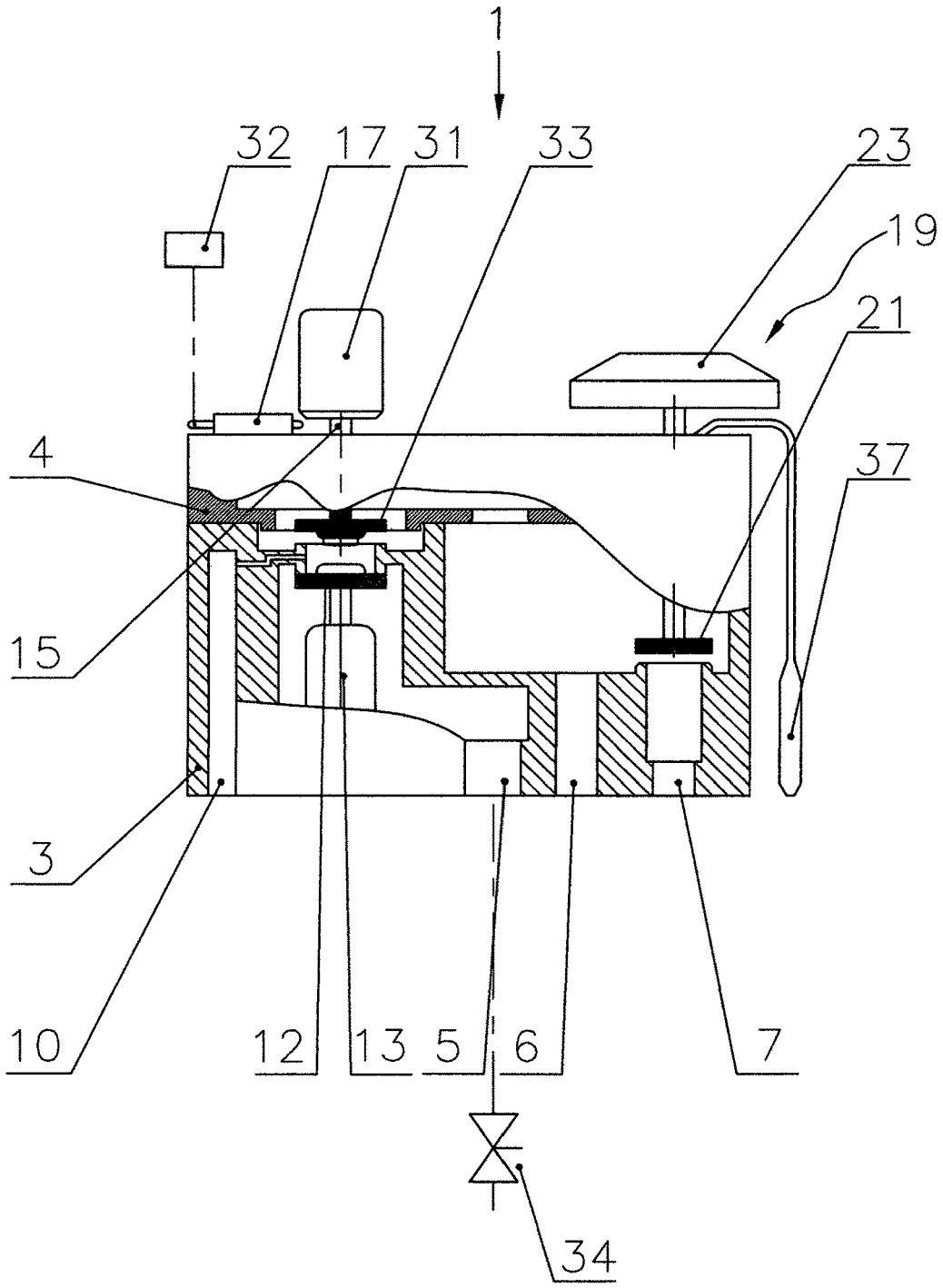

For the second example:

FIG. 4 is a first valve of the device according to the disclosure in the ignition position;

FIG. 5 is the first valve of the device according to the disclosure from FIG. 4 in the operating position in combination with a second valve of the device according to the disclosure; and FIG. 6 is the first valve of the device according to the disclosure from FIG. 4 in the off position.

DETAILED DESCRIPTION

1st Execution Example

The first valve of the device according to the disclosure exemplified in FIGS. 1, 1*a*, 2 and 3 is a switching and control device which is preferably intended for a gas operated heating device or the like. It facilitates the operation and monitoring of a first burner, the pressure regulation as well as the setting and regulation of the required temperature by regulating the amount of gas flowing to the burner.

The first valve (1) comprises a lower housing part (3) and an upper housing part (4), which has a gas inlet (5), a first gas outlet (6), a second gas outlet (7) and a pilot gas outlet (10). The following functional units are accommodated in the housing (3;4) in the direction of flow of the gas:

Start-up with associated control element (14), optionally with piezo igniter (16) or with switch for an electric ignition (17);

Safety pilot valve (12) safety pilot magnet (13) and ignition lock (11), optionally with pressure regulator (18); and Thermostat 1 (19) comprising temperature travel sensor 1 (37), snap-action switch 1 (35), valve closing body 1 (21) and temperature adjuster 1 (23) for regulating the amount of gas flowing to the burner 1 (26).

The structure and mode of operation of the start-up, the safety pilot valve (12), the ignition lock (11), the pressure regulator (18) and the thermostat 1 (19) are known to those skilled in the art. A more detailed depiction and explanation of the individual components has therefore not been provided in this execution example.

Figure 2:
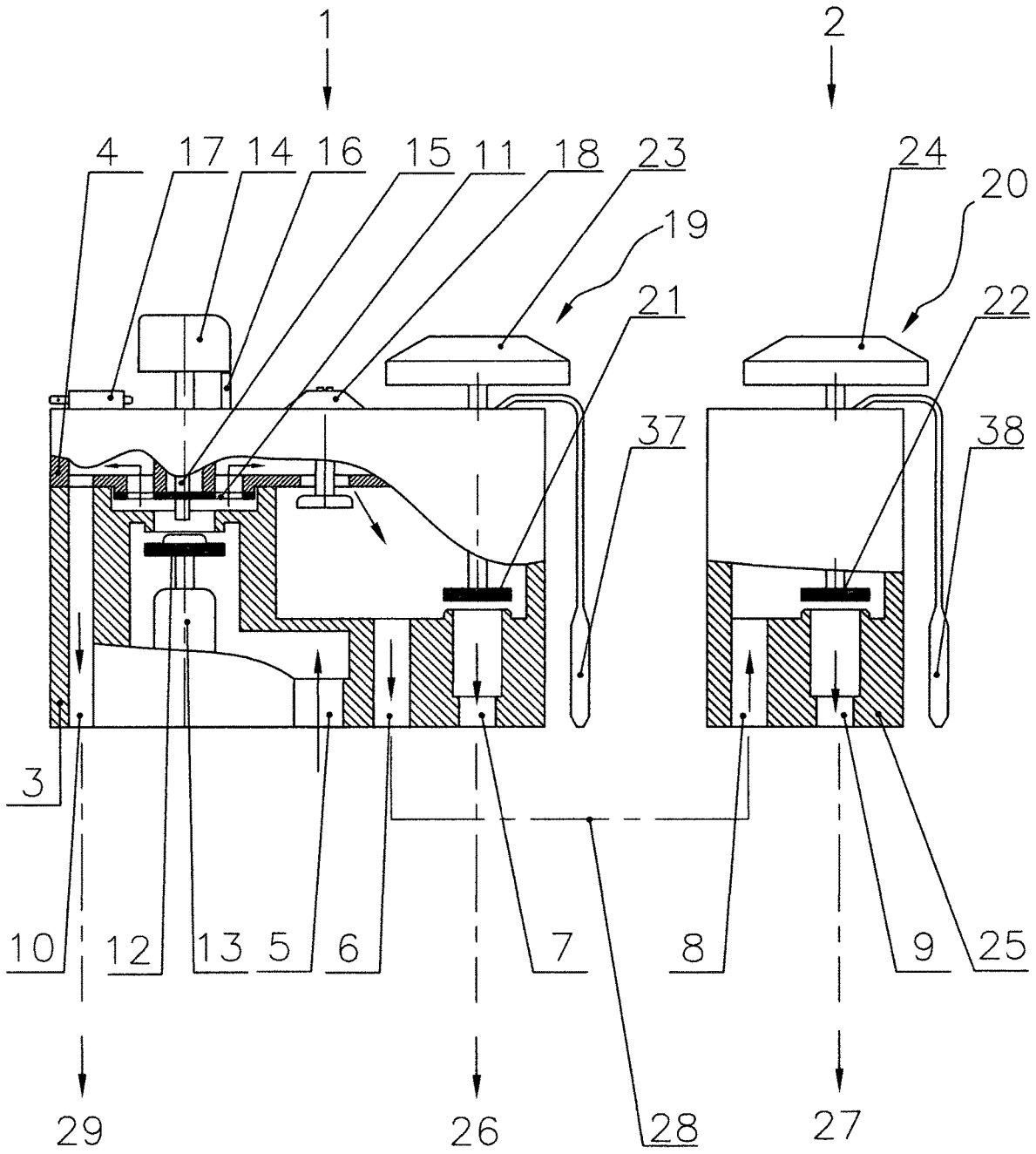
FIG. 2 is the first valve of the device according to the disclosure from FIG. 1 in the operating position in combination with a second valve of the device according to the disclosure.

The second valve of the device according to the disclosure exemplified in FIG. 2 contains a thermostat. This enables the required temperature at the second burner to be set and regulated by controlling the amount of gas flowing to the second burner.

The second valve (2) comprises a housing (25), a gas inlet (8) and a gas outlet (9). A thermostat 2 (20) is arranged in the housing (25) in the direction of the gas flow, comprising a temperature travel sensor 2 (38), a snap-action switch 2 (36), a valve closing body 2 (22) and a temperature adjuster (24) for regulating the amount of gas flowing to the burner 2 (27).

Valve 1 (1) and valve 2 (2) are connected together by a pipe (28) in a gas-tight manner according to the disclosure. At the same time, the gas outlet 1 (6) of valve 1 is connected to the gas inlet (8) of valve 2.

The burners 1 (26) and burner 2 (27) are connected together in a gas-tight manner by means of pipes, with burner 1 (26) connected to gas outlet 2 (7) of valve 1 and burner 2 (27) connected to gas outlet (9) of valve 2. The pilot gas outlet (10) of valve 1 serves to connect the pilot burner (29). The thermocouple (30) is electrically conductively attached to the connection thread of the safety pilot magnet (13), as is known to those skilled in the art. The pilot burner (29), which is not shown, with thermocouple (30), is preferably positioned such that the pilot flame safely reaches both burners and the thermocouple. This ensures that, if required, either burner 1 alone or burner 2 alone can be put into operation, or that burner 1 and burner 2 can be put into operation simultaneously by means of the pilot flame. Sufficient flame control is also provided by this means. The device according to the disclosure is connected to the gas network via the gas inlet (5) of valve 1.

Figure 1:
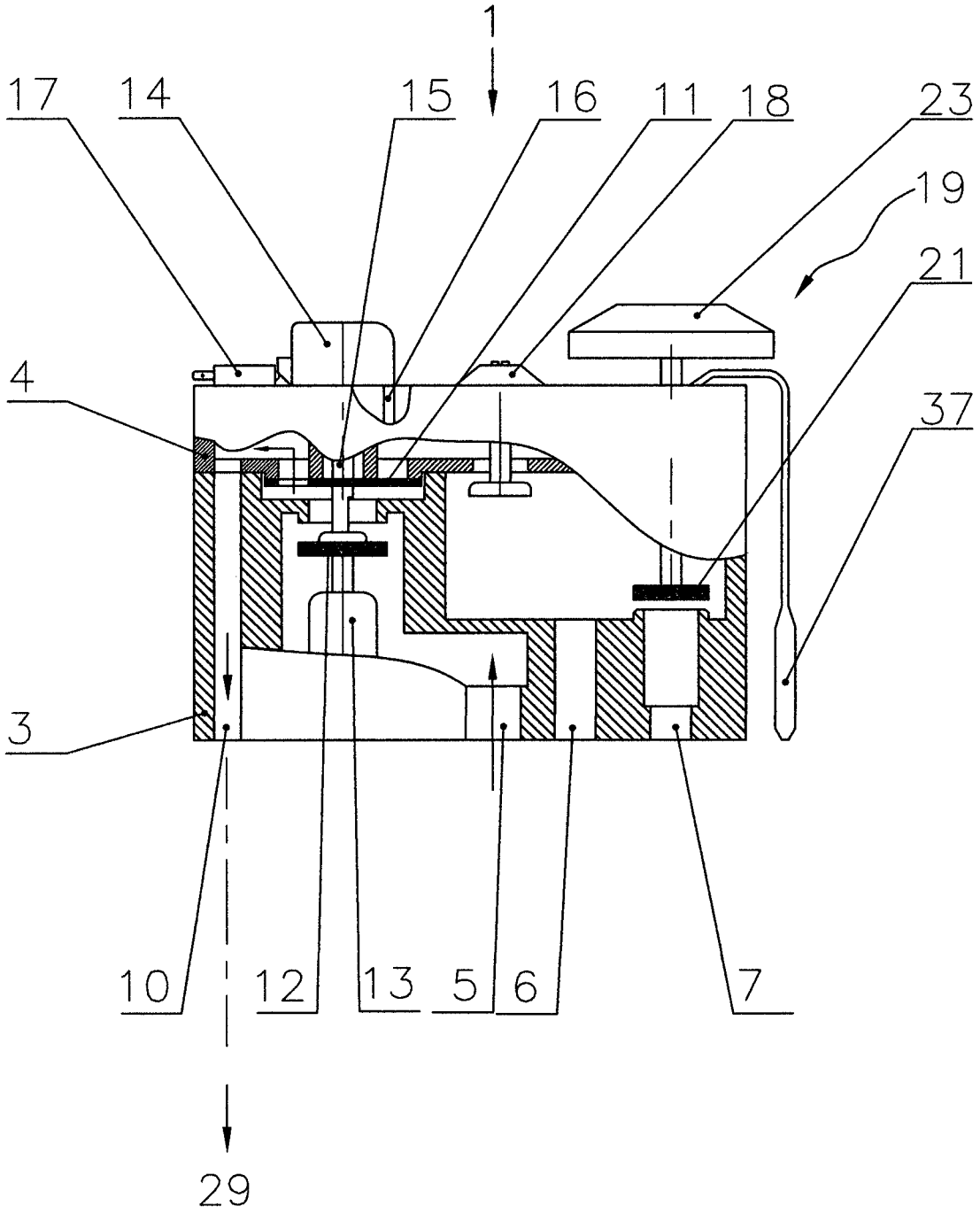
FIG. 1 is a first valve of the device according to the disclosure in the ignition position.

The device is started up via valve 1 as shown in FIG. 1. Initially, the pilot flame of the pilot burner (29) is ignited.

Figure 1A:
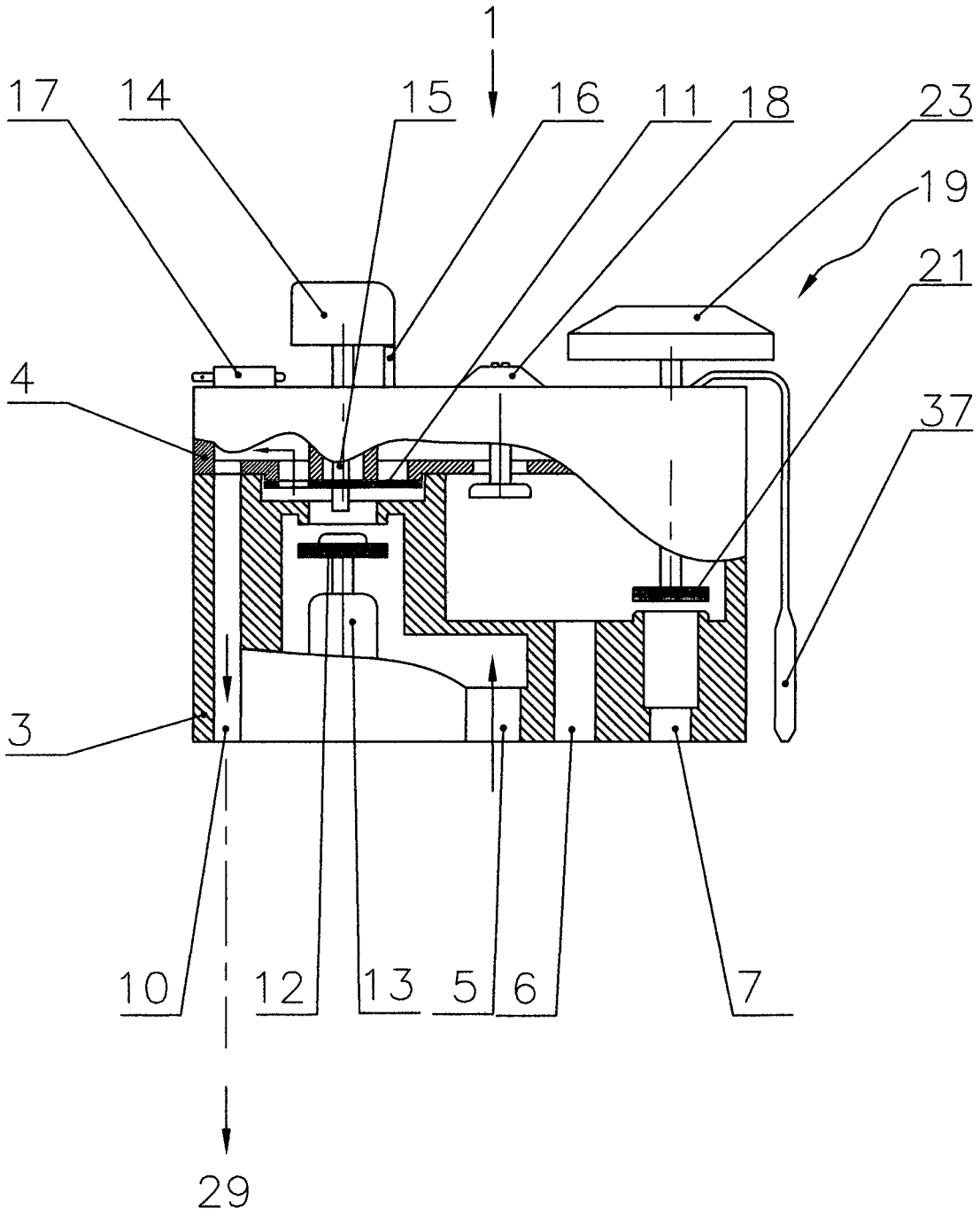
FIG. 1*a* is a first valve of the device according to the disclosure in the standby position.

The standby position shown in FIG. 1*a* can be set if required. In this position the pilot flame is lit but the ignition lock (11) prevents any gas flow being released to the first burner (26) and to the second valve (2). This enables the user to start up the application quickly without the pilot gas having to be ignited in each case beforehand.

As shown in FIG. 2, a required temperature is pre-set by the temperature adjuster 1 (23), and the valve closing body 1 (21) is moved to a control position whereby the gas flows through gas outlet 2 (7) to burner 1 (26) and is ignited. The liquid-filled temperature travel sensor 1 (37) is positioned at an optimum distance from the medium to be regulated so that the required temperature pre-set by the temperature adjuster 1 (23) can be attained and kept constant. If required, the second burner (27) can also be put into operation. For this purpose, a required temperature is pre-set by the temperature adjuster 2 (24) of valve 2 (2) and the valve closing body 2 (22) is moved to a control position, whereby the gas flows from the gas outlet 1 (6) of valve 1 through the connection (28), a gas-tight connecting pipe, to the gas inlet (8) of the second valve (2), passes the opened valve closing body (22) and reaches the burner 2 (27) via the gas outlet (9) and is also ignited by the pilot burner (29).

As described above, other operations of the burners are also possible as an option, whereby burner 2 alone is put into operation or both burners are put into operation simultaneously. To that end the respective temperature adjusters of the valves are moved to a control position.

It has proved to be advantageous as an option to integrate the pressure regulator (18) in valve 1. This compensates for pressure fluctuations in the gas network and maintains a stable burner pressure. A suitable geometric design in the housings makes possible an approximately equal pressure drop across both valves between the inlet (5) of the first valve (1) and the outlets of both valves (7;9), enabling two identical burners (26;27) to be used in a cost-effective manner.

Figure 3:
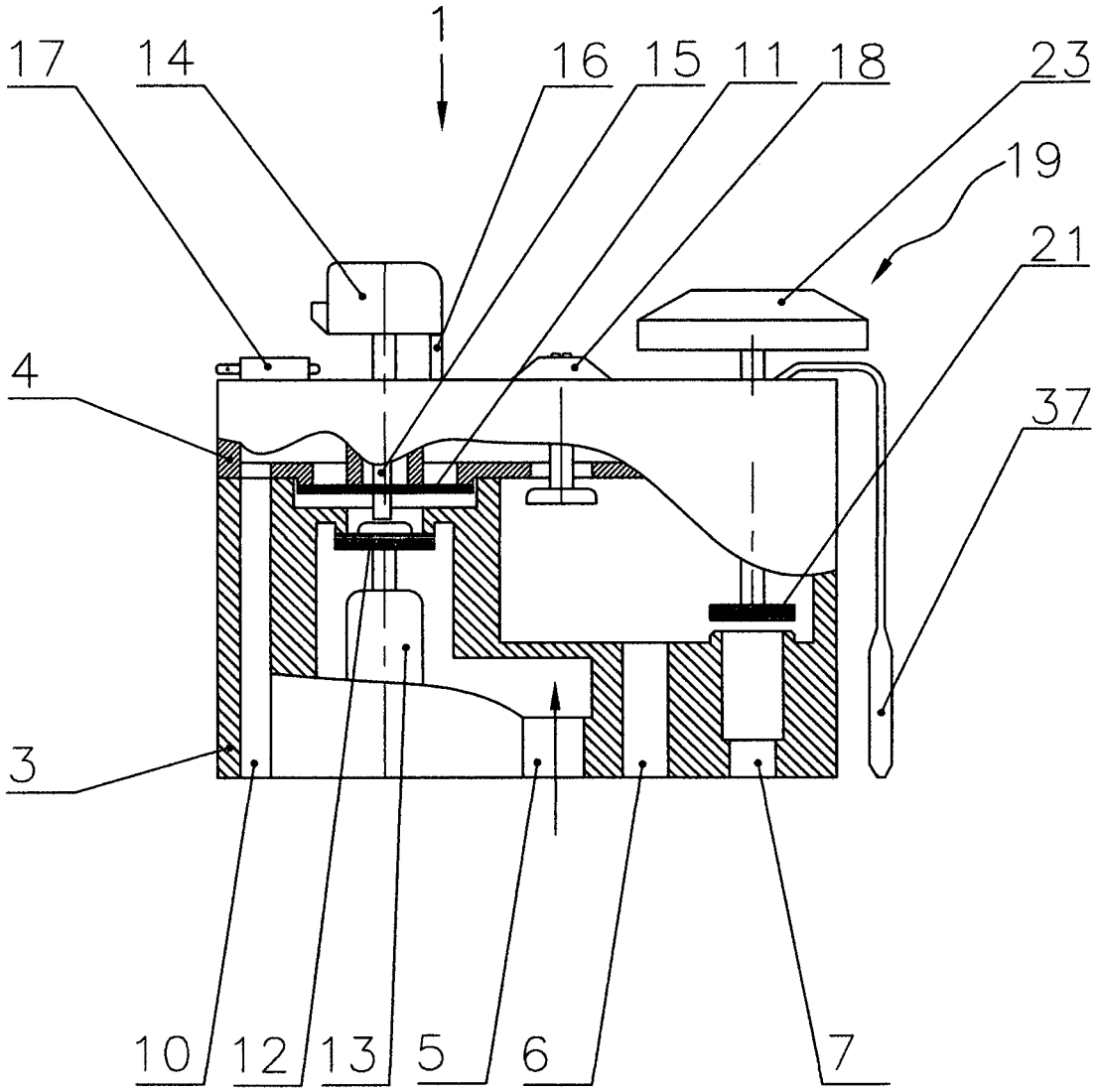
FIG. 3 is the first valve of the device according to the disclosure from FIG. 1 in the off position.

FIG. 3 shows the possible deactivation of both burners via the start-up. By turning the start-up, preferably a knob, to the off position, the main gas supply and the pilot gas supply are interrupted simultaneously via the ignition lock (11), the thermocurrent generated by the thermocouple (30) breaks down, the safety pilot magnet (13) drops out and the safety pilot valve (12) closes. To restart the device, it is then necessary to re-ignite the pilot flame via the startup (14) and to apply the safety pilot magnet.

Starting from a standby position, with pilot flame on, safety pilot magnet (13) applied and ignition lock (11) in open position, the user has alternatively the option of switching off burner 1 or burner 2 independently of each other, or of switching both burners off by means of the respective temperature adjusters. Moving the respective temperature adjuster to a control position suffices to restart the device. The burner is ignited immediately by the pilot flame.

2nd Execution Example

Many users of kitchen equipment would like such equipment to be even easier to operate.

A start-up via valve 1 by means of a pushbutton and battery ignition is therefore described in the second execution example.

Valve 1 of execution example 2 has a different structure from that of valve 1 of execution example 1 in that it has a different start-up.

The connection of both valves according to the disclosure as well as the arrangement of the temperature travel sensors has been adopted in this second application example.

FIG. 4 shows the modified start-up in the ignition position.

Simply pressing the button (31) of the start-up triggers the following sequence, which is performed via the operating rod (15) at the same time as the application of the safety pilot magnet (13): the overflow of gas through the pilot gas outlet (10) to the pilot burner (29) is released, a switch (17) is activated, which generates a clock ignition spark via an electric ignition spark generator (32), and the pilot gas is ignited.

At the time of the ignition of the pilot gas, the closed main valve (33) prevents an over-ignition at the burner(s).

The thermocouple (30) is heated by the ignited pilot flame and a voltage is generated which holds the safety pilot magnet in the open position.

As shown in FIG. 5, the main valve (33) is opened when the button (31) is released.

The gas can now flow in a similar way to execution example 1 via gas outlet 1 (6) to valve 2 and thus to burner 2) and/or via gas outlet 2 (7) to burner 1. The burners are ignited by the pilot burner (29) which is in operation and is optimally positioned in relation to the burners.

The state of deactivation is shown in FIG. 6.

The thermocouple (30) which is arranged in sufficient proximity to the pilot burner and the burners is used as a monitoring device as is also described in application example 1. In the event of faults causing the pilot flame to go out, the thermocouple cools down and the thermocurrent breaks down. The safety pilot valve (12) interrupts the gas supply.

The burners are switched on and off and the temperature is set by the thermostats 1 and 2 in the same way as in application example 1.

In contrast to application example 1, the device is completely shut down by an upstream shutdown device (34) which is not shown.

The device for regulating the gas supply according to the disclosure is not, of course, limited to the execution examples described. On the contrary, modifications, variations and combinations are possible without departing from the scope of the disclosure.

| List of reference numerals | |
|---|---|
| 1 | Valve 1 |
| 2 | Valve 2 |
| 3 | Housing lower part |
| 4 | Housing upper part |
| 5 | Gas inlet valve 1 |
| 6 | Gas oulet 1 valve 1 |
| 7 | Gas outlet 2 valve 1 |
| 8 | Gas inlet valve 2 |
| 9 | Gas outlet valve 2 |
| 10 | Pilot gas outlet |
| 11 | Ignition lock |
| 12 | Safety pilot valve |
| 13 | Safety pilot magnet |
| 14 | Start-up |
| 15 | Operating rod |
| 16 | Piezo igniter |
| 17 | Switch for an electric ignition |
| 18 | pressure regulator |
| 19 | Thermostat 1 |
| 20 | Thermostat 2 |
| 21 | Valve closing body 1 |
| 22 | Valve closing body 2 |
| 23 | Temperature adjuster 1 |
| 24 | Temperature adjuster 2 |
| 25 | Hosing valve 2 |
| 26 | Burner 1, not shown |
| 27 | Burner 2, not shown |
| 28 | Connection |
| 29 | Pilot burner, not shown |
| 30 | Thermocouple, not shown |
| 31 | Button start up |
| 32 | Ignition spark generator |
| 33 | Main valve |
| 34 | Shut-off device |
| 35 | Snap-action switch 1, not shown |
| 36 | Snap action switch 2, not shown |
| 37 | Temperature travel sensor 1 |
| 38 | Temperature travel sensor 2 |

The invention claimed is:

1. A universally applicable control device for a gas-operated heating device having more than one burner, the control device comprising: a first valve (1) and a second valve (2) connected (28) to each another in a gas-tight manner, wherein the first valve (1) has an ignition lock which closes the main gas flow during ignition, a thermoelectric ignition fuse (11;12;13), and a thermostat (19), wherein the gas flow is switched on and off via start-up (14), wherein the first valve (1) has a first gas outlet (6) for the connection of the second valve (2), which is arranged downstream of the ignition fuse (11; 12;13) and upstream of the thermostat (19), and has a second gas outlet (7) which is downstream of the thermostat (19) and which leads to first burner (26), and wherein the first outlet (6) of the first valve (1) is connected to an inlet (8) of the second valve (2), and an outlet (9) of the second valve (2) is connected to second burner (27) and wherein the second valve (2) comprises a thermostat (20) wherein both valves (1;2) have approximately the same pressure drop across between inlet (5) of the first valve (1) and the outlets (7;9) of both valves (1;2), enabling the two burners (26;27) to be operated.

2. The control device for a gas-operated heating device having more than one burner according to claim 1, wherein both thermostats (19;20) have a cut-off function (21;22).

3. The control device for a gas-operated heating device having more than one burner according to claim 1, wherein both thermostats (19;20) have a cut-off function (21;22).

4. The control device for a gas-operated heating device having more than one burner according to claim 1, further comprising a pressure regulator (18).

5. The control device for a gas-operated heating device having more than one burner according to claim 1, further comprising an integrated piezo igniter (16).

6. The control device for a gas-operated heating device having more than one burner according to claim 1, further comprising a switch (17) for activating an electric igniter.

7. A universally applicable control device for a gas-operated heating device having more than one burner, the control device comprising: a first valve (1) and a second valve (2) connected (28) to each another in a gas-tight manner, wherein the first valve (1) has an ignition lock which closes the main gas flow during ignition, a thermoelectric ignition fuse (11;12;13), and a thermostat (19), wherein the gas flow is switched on and off via start-up (14), wherein the first valve (1) has a first gas outlet (6) for the connection of the second valve (2), which is arranged downstream of the ignition fuse (11; 12;13) and upstream of the thermostat (19), and has a second gas outlet (7) which is downstream of the thermostat (19) and which leads to first burner (26), and wherein the first outlet (6) of the first valve (1) is connected to an inlet (8) of the second valve (2), and an outlet (9) of the second valve (2) is connected to second burner (27) and wherein the second valve (2) comprises a thermostat (20), wherein both thermostats (19;20) have a cut-off function (21;22).

8. The control device for a gas-operated heating device having more than one burner according to claim 1, wherein both valves (1;2) have approximately the same pressure drop across between inlet (5) of the first valve (1) and the outlets (7;9) of both valves (1;2), enabling the two burners (26;27) to be operated.

9. The control device for a gas-operated heating device having more than one burner according to claim 8, wherein both thermostats (19;20) have a cut-off function (21;22).

10. The control device for a gas-operated heating device having more than one burner according to claim 7, further comprising a pressure regulator (18).

11. The control device for a gas-operated heating device having more than one burner according to claim 7, further comprising an integrated piezo igniter (16).

12. The control device for a gas-operated heating device having more than one burner according to claim 7, further comprising a switch (17) for activating an electric igniter.

13. A universally applicable control device for a gas-operated heating device having more than one burner, the control device comprising: a first valve (1) and a second valve (2) connected (28) to each another in a gas-tight manner, wherein the first valve (1) has an ignition lock which closes the main gas flow during ignition, a thermo-electric ignition fuse (11;12;13), and a thermostat (19), wherein the gas flow is switched on and off via start-up (14), wherein the first valve (1) has a first gas outlet (6) for the connection of the second valve (2), which is arranged downstream of the ignition fuse (11; 12;13) and upstream of the thermostat (19), and has a second gas outlet (7) which is downstream of the thermostat (19) and which leads to first burner (26), and wherein the first outlet (6) of the first valve (1) is connected to an inlet (8) of the second valve (2), and an outlet (9) of the second valve (2) is connected to second burner (27) and wherein the second valve (2) comprises a thermostat (20), and a pressure regulator (18).

14. The control device for a gas-operated heating device having more than one burner according to claim 13, wherein both valves (1;2) have approximately the same pressure drop across between inlet (5) of the first valve (1) and the outlets (7;9) of both valves (1;2), enabling the two burners (26;27) to be operated.

15. The control device for a gas-operated heating device having more than one burner according to claim 14, wherein both thermostats (19;20) have a cut-off function (21;22).

16. The control device for a gas-operated heating device having more than one burner according to claim 13, further comprising an integrated piezo igniter (16).

17. The control device for a gas-operated heating device having more than one burner according to claim 13, further comprising a switch (17) for activating an electric igniter.

* * * * *